US011430363B1

(12) United States Patent
Chou et al.

(10) Patent No.: US 11,430,363 B1
(45) Date of Patent: Aug. 30, 2022

(54) DATA DRIVING CIRCUIT AND DISPLAY APPARATUS WITH REDUCED POWER CONSUMPTION

(71) Applicant: JADARD TECHNOLOGY INC., Shenzhen (CN)

(72) Inventors: Chien-Pang Chou, Shenzhen (CN); Da-Ming Dai, Shenzhen (CN)

(73) Assignee: JADARD TECHNOLOGY INC., Shenzhen (CN)

( * ) Notice: Subject to any disclaimer, the term of this patent is extended or adjusted under 35 U.S.C. 154(b) by 0 days.

(21) Appl. No.: 17/466,034

(22) Filed: Sep. 3, 2021

(30) Foreign Application Priority Data

Apr. 16, 2021 (CN) ..... 202110413195.2

(51) Int. Cl.
*G09G 3/20* (2006.01)

(52) U.S. Cl.
CPC ..... *G09G 3/20* (2013.01); *G09G 2310/027* (2013.01); *G09G 2310/0267* (2013.01); *G09G 2310/0286* (2013.01); *G09G 2310/0289* (2013.01); *G09G 2310/08* (2013.01)

(58) Field of Classification Search
None
See application file for complete search history.

(56) References Cited

U.S. PATENT DOCUMENTS

| | | | | |
|---|---|---|---|---|
| 11,081,038 | B1 | 8/2021 | Lin et al. | |
| 2007/0296680 | A1* | 12/2007 | Lee | G09G 3/3685 345/100 |
| 2010/0220080 | A1* | 9/2010 | Kojima | G09G 3/3291 345/204 |
| 2020/0152115 | A1 | 5/2020 | Tu et al. | |

FOREIGN PATENT DOCUMENTS

| | | | |
|---|---|---|---|
| CN | 107221290 | A | 9/2017 |
| CN | 111161681 | A | 5/2020 |
| CN | 112216242 | A | 1/2021 |

* cited by examiner

*Primary Examiner* — Christopher J Kohlman
(74) *Attorney, Agent, or Firm* — ScienBiziP, P.C.

(57) ABSTRACT

A data driving circuit of reduced power consumption by smoothing large voltage changes includes a shift register circuit, a first latch, a second latch, a level shift circuit, a digital-to-analog (DAC) circuit, and an output circuit. The first latch circuit samples the digital signal, the second latch circuit detects a boundary value of the sampled signal in a specified grayscale range. The boundary value of the sampled signal is compared with the boundary value of a previous sampled signal and if different from the previous boundary value, the second latch outputs a compensation control signal being effective; the output circuit sets the voltage of the data line at a specified voltage before outputting the driving voltage to the data line. A display apparatus is also disclosed.

10 Claims, 4 Drawing Sheets

DATA DRIVING CIRCUIT AND DISPLAY APPARATUS WITH REDUCED POWER CONSUMPTION

FIELD OF THE INVENTION

The subject matter herein generally relates to energy saving, particularly relates to a data driving circuit for a display apparatus.

BACKGROUND

Displays are widely used in electronic device as an inputting and outputting device, for communication with a user. Each display includes a display panel and a display driving circuit. The display panel includes a plurality of data lines and a plurality of scan lines intersecting the data lines. A plurality of pixel units are defined by the data lines and the scan lines. The display driving circuit is in a non-display region of the display. The driving circuit outputs different signals to the data lines and the scan lines for driving the display panel to display images. The data driving circuit converts N bits of digital signal into driving voltage to the corresponding pixel unit. When the signal of the data changes for different frames, such as from a low voltage level to a high voltage level, a power dissipation of the driving circuit increases, and a stand-by time of the display is reduced.

Therefore, there is room for improvement in the art.

BRIEF DESCRIPTION OF THE DRAWINGS

Implementations of the present disclosure will now be described, by way of example only, with reference to the attached figures.

DETAILED DESCRIPTION

Figure 1:
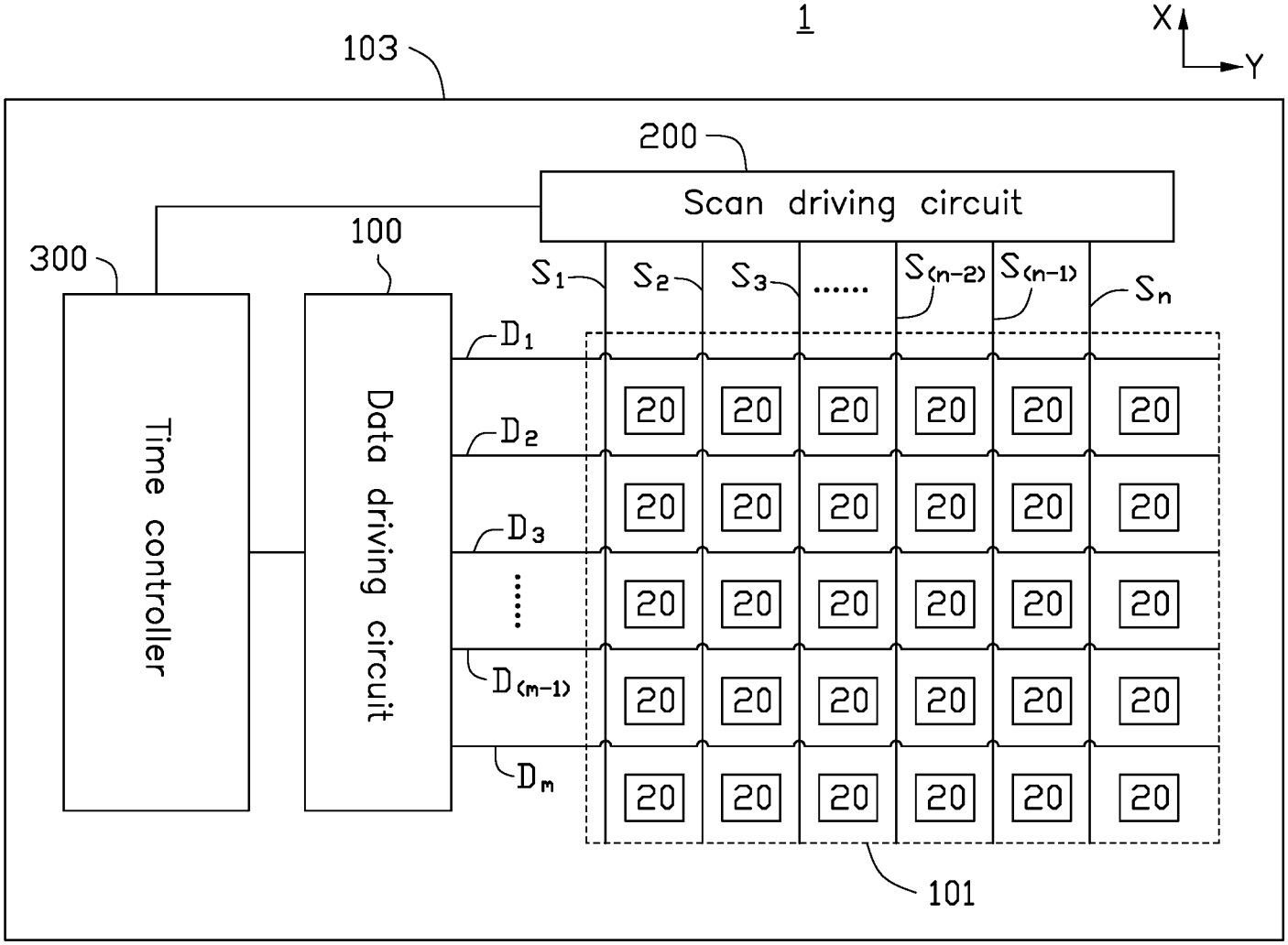
FIG. 1 is a diagram illustrating an embodiment of a display apparatus according to the present disclosure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

The term "comprising" means "including, but not necessarily limited to"; it specifically indicates open-ended inclusion or membership in a so-described combination, group, series, and the like. The disclosure is illustrated by way of example and not by way of limitation in the figures of the accompanying drawings in which like references indicate similar elements. It should be noted that references to "an" or "one" embodiment in this disclosure are not necessarily to the same embodiment, and such references can mean "at least one."

The present disclosure relates to a data driving circuit in a display apparatus.

FIG. 1 shows a display apparatus 1. The display apparatus 1 defines a display region 101 and a non-display region 103 surrounding the display region 101. The display region 101 includes a plurality of scan lines $S_1$-$S_n$ and a plurality of data lines $D_1$-$D_m$. In one embodiment, n and m are positive integers. The scan lines $S_1$-$S_n$ are parallel with each other along a first direction X, and the data lines $D_1$-$D_m$ are parallel with each other along a second direction Y, the direction Y being perpendicular to the first direction X. The scan lines $S_1$-$S_n$ intersect with but are insulated from the data lines $D_1$-$D_m$ to define a number of pixel units 20 in a matrix. In other embodiments, the crossing angle of scan lines $S_1$-$S_n$ with the data line $D_1$-$D_m$ are at a specified angle.

The display apparatus 1 includes a data driving circuit 100, a scan driving circuit 200, and a time controller 300. Each scan line $S_i$ is electrically connected between the scan driving circuit 200 and the pixel units 20 in one column. Each data line $D_m$ is electrically connected between the data driving circuit 100 and the pixel units 20 in one line. The time controller 130 is electrically connected to the data driving circuit 100 and the scan driving circuit 200. The time controller 130 generates various control signals. The various control signals may include synchronization signals, such as a vertical synchronization (Vsync) signal, a horizontal synchronization (Hsync) signal, and a data enable (DE) signal, and non-synchronization signals. In one embodiment, the time controller 130 generates first clock signal CLK and a second clock signal MCLK to the data driving circuit 100. The data driving circuit 100 converts a digital signal into a driving voltage and provides the driving voltage to the data lines $D_1$-$D_m$ for displaying images. The scan driving circuit 200 provides scan signals to the pixel units 20 through the scan lines $S_1$-$S_n$ for scanning the pixel units 20.

Figure 2:
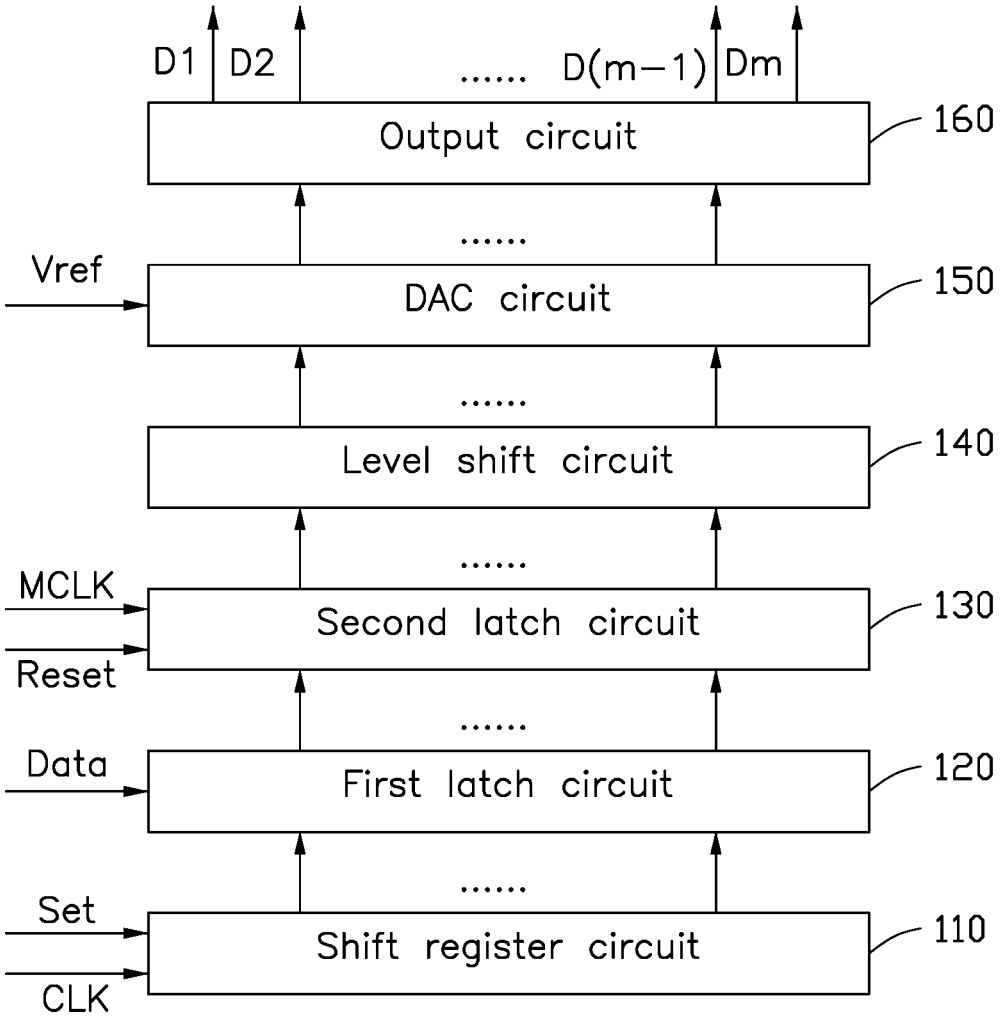
FIG. 2 is a diagram illustrating an embodiment of the data driving circuit for a display apparatus according to the present disclosure.

FIG. 2 shows a diagram of the data driving circuit 100. The data driving circuit 100 includes a shift register circuit 110, a first latch circuit 120, a second latch circuit 130, a level shift circuit 140, a digital-to-analog (DAC) circuit 150, and an output circuit 160.

The shift register circuit 110 receives a start signal Set from the time controller 300 and the first clock signal CLK and generates a sampling pulse signal.

The first latch circuit 120 is electrically connected to the shift register 110. The first latch circuit 120 receives a digital signal Data from the time controller 300 and the sampling pulse signal. The first latch circuit 120 samples the digital signal Data based on the sampling pulse signal to obtain a sampled signal Sample.

The second latch circuit 130 is electrically connected to the first latch circuit 120 and the time controller 300. The second latch circuit 130 receives the second clock signal MCLK from the time controller 300 and a reset signal Reset. The second latch circuit 130 latches the sampled signal Sample based on the second clock signal MCLK and the reset signal Reset. The second latch circuit 130 further detects a boundary value of the sampled signal Sample in a specified grayscale range. When the boundary value of the sample signal Sample changes in comparison with the boundary value of the sample signal Sample in a previous time, the second latch circuit 130 generates a compensation control signal COM. In one embodiment, using an 8 bit digital signal as an example, the specified grayscale range is from 65 grayscale to 191 grayscale. In other embodiments, the specified grayscale range can be adjusted according to the bit of the digital signal Data.

Figure 3:
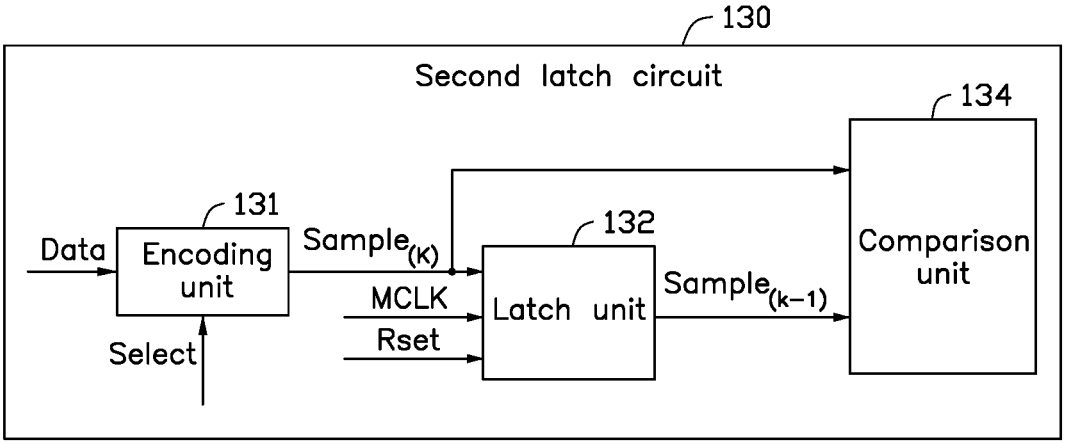
FIG. 3 is a circuit diagram illustrating an embodiment of a second latch circuit according to the present disclosure.

FIG. 3 shows a circuit diagram of the second latch circuit 130. The second latch circuit 130 includes an encoding unit 131, a latch unit 132, and a comparison unit 134.

The encoding unit 131 receives the digital signal Data and a selection signal SEL. The encoding unit 131 sets the specified grayscale range based on the selection signal SEL, and converts the digital signal Data to obtain a sampled signal $Sample_{(d\ k)}$, and outputs the sampled signal $Sample_{(k)}$ corresponding to the data line $D_{(k)}$ in the set specified grayscale range to the latch unit 132 and the comparison unit 134.

The latch unit 132 receives the second clock MCLK, the reset signal Reset, and the sampled signal $Sample_{(k)}$ corresponding to the data line $D_{(k)}$ The latch unit 132 further latches a previous sampled signal $Sample_{(k-1)}$ corresponding to the data line $D_{(k-)}$. At a rising edge of the second clock signal MCLK, the latch unit 132 outputs the previous sampled signal $Sample_{(k-1)}$ corresponding to the data line $D_{(k-1)}$ to the comparison unit 134.

Figure 4:
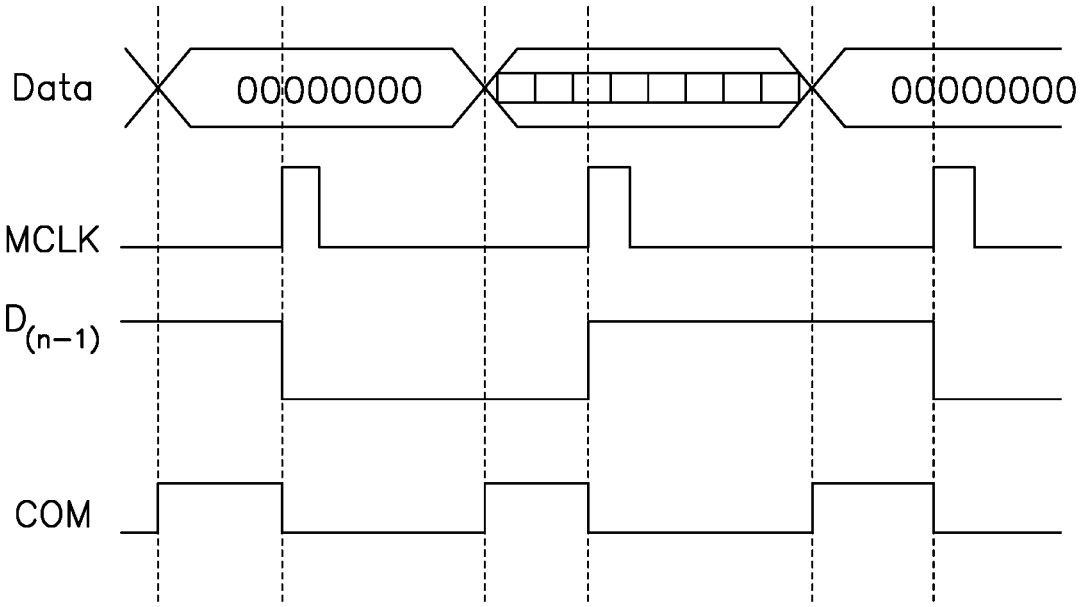
FIG. 4 is a timing chart showing waveforms of a digital signal, a second clock signal, a previous sampled signal, and a compensation control signal in the second latch circuit of FIG. 3.

The comparison unit 134 is electrically connected to the encoding unit 131 and the latch unit 132. The comparison unit 134 compares the boundary value of the sampled signal $Sample_{(k)}$ corresponding to the data line $D_{(k)}$ with the boundary value of the previous sampled signal $Sample_{(k-1)}$ corresponding to the data line $D_{(k-1)}$. When the boundary value of the sampled signal $Sample_{(k)}$ corresponding to the data line $D_{(k)}$ is different from the boundary value of the previous sampled signal $Sample_{(k-1)}$ corresponding to the data line D(k-1), the compensation control signal COM is effective. When the boundary value of the sampled signal $Sample_{(k)}$ corresponding to the data line $D_{(k)}$ is the same as the previous sampled signal $Sample_{k-1}$) corresponding to the data line $D_{(k-1)}$, the compensation control signal COM is ineffective. In one embodiment, as shown in FIG. 4, the compensation control signal COM being the high level voltage is effective, and the compensation control signal COM being in the low level voltage is ineffective. The boundary value of the sampled signal $Sample_{(k)}$ is a most significant bit of the sample signal $Sample_{(k)}$. In other embodiments, the boundary value can be other bit of the sampled signal $Sample_{(k)}$)

The level shift circuit 140 is electrically connected to the second latch circuit 130. The level shift circuit 140 modules the sampled signal Sample.

The DAC circuit 150 is electrically connected to the level shift circuit 140. The DAC circuit 150 receives a reference voltage Vref and converts the sampled signal into the driving voltage based on the reference voltage Vref.

The output circuit 160 is electrically connected to the DAC circuit 150 and the data lines $D_1$-$D_m$. The output circuit 160 outputs the driving voltage to the corresponding data lines $D_1$-$D_m$. The output circuit 160 further sets the data line $D_{(k)}$ to a specified voltage before outputting the driving voltage to the corresponding data line $D_{(k)}$, when the compensation control signal COM is effective. The setting operation can be a charging operation or a discharging operation. When the compensation control signal COM is ineffective, the output circuit 160 directly outputs the driving voltage to the corresponding data line $D_{(k)}$.

FIG. 4 shows a timing chart showing waveforms of the digital signal, the second clock signal, a previous sampled signal, and a compensation control signal.

With the sampled signal $Sample_{(k)}$ in the specified grayscale range, the encoding unit 131 outputs the sampled signal $Sample_{(k)}$ corresponding to the data line $D_{(k)}$ in the set specified grayscale range to the latch unit 132. The latch unit 132 outputs the previous sampled signal $Sample_{(k-1)}$ corresponding to the data line $D_{(k-1)}$ to the comparison unit 134 at the rising edge of the second clock signal MCLK. When the boundary value of the sampled signal $Sample_{(k)}$ corresponding to the data line $D_{(k)}$ is different from the boundary value of the previous sampled signal $Sample_{(k-1)}$ corresponding to the data line $D_{(k-1)}$, the comparison unit 134 outputs the compensation control signal COM being effective. The output circuit 160 sets the voltage of the corresponding data line $D_{(k)}$ at the specified voltage before outputting the driving voltage to the corresponding data line $D_{(k)}$.

Based on the structure of the data driving circuit 100 and the display apparatus 1, the specified grayscale range is set based on the selection signal SEL, and the boundary value of the sampled signal $Sample_{(k)}$ in the specified grayscale range is detected. When the boundary value of the sampled signal $Sample_{(k)}$ is changed by comparison with the boundary value of the previous sampled signal $Sample_{(k-1)}$, the compensation signal COM being effective is outputted for setting the voltage of the corresponding data line $D_{(k)}$ at the specified voltage before outputting the driving voltage to the corresponding data line $D_{(k)}$. A large voltage change of the data line between different frames is thus reduced, also reducing power dissipation of the data driving circuit 100.

While various and preferred embodiments have been described the disclosure is not limited thereto. On the contrary, various modifications and similar arrangements (as would be apparent to those skilled in the art) are also intended to be covered. Therefore, the scope of the appended claims should be accorded the broadest interpretation so as to encompass all such modifications and similar arrangements.

What is claimed is:

1. A data driving circuit configured for converting digital signal into driving voltages to data lines, the data driving circuit comprising:

a shift register circuit, configured to output a sampling pulse signal based on a start signal and a first clock signal;

a first latch circuit electrically connected to the shift register circuit, and configured to sample the received digital signal to obtain a sampled signal based on the sampling pulse signal;

a second latch circuit electrically connected to the first latch circuit, and configured to detect a boundary value of the sampled signal in a specified grayscale range;

a level shift circuit electrically connected to the second latch circuit, and configured to modulate the sampled signal;

a digital-to-analog (DAC) circuit electrically connected to the level shift circuit, and configured to convert the modulated sampled signal into a driving voltage according to a reference voltage; and an output circuit electrically connected to the DAC circuit, and configured to output the driving voltage to a data line;

wherein the second latch circuit further compares the boundary value of the sampled signal with the boundary value of a previous sampled signal and outputs a compensation control signal to the output circuit based on a comparison result, wherein if the boundary value of the sampled signal is different from the boundary value of the previous sampled signal, the compensation control signal is in an effective state; the output circuit further sets the voltage of the data line at a specified voltage in response to the compensation control signal in the effective state before outputting the driving voltage to the data line;

wherein the specified grayscale range can be adjusted according to a bit number of the digital signal.

2. The data driving circuit of claim 1, wherein the second latch circuit comprises a encoding unit, a latch unit, and a comparison unit; the encoding unit receives the digital signal and a selection signal; the encoding unit sets the specified grayscale range based on the selection signal, and converts the digital signal to obtain a sampled signal; the latch unit latches a previous sampled signal corresponding to the data line, and outputs the previous sampled signal corresponding to the data line to the comparison unit, and latches the current sampled signal; the comparison unit compares the boundary value of the sampled signal and the boundary value of the previous sampled signal.

3. The data driving circuit of claim 1, wherein the boundary value is a most significant bit of the sample signal.

4. The data driving circuit of claim 1, wherein the specified grayscale range is from 65 grayscale to 191 grayscale.

5. The data driving circuit of claim 1, wherein if the boundary value of the sampled signal is the same as the boundary value of the previous sampled signal, the compensation control signal is in an ineffective state; the output circuit outputs the driving voltage to the corresponding data line.

6. A display apparatus comprising:

a plurality of scan lines;

a plurality of data lines intersecting with the scan lines to define a plurality of pixel units;

a scan driving circuit, electrically connected to the scan lines, and configured to provide scan signal to the pixel unit by the scan lines;

a time controller configured to provide a first clock signal and a second clock signal; and a data driving circuit, electrically connected to the data lines, and configured to convert digital signal into driving voltages; the data driving circuit comprising:

a shift register circuit, configured to output a sampling pulse signal based on a start signal and a first clock signal;

a first latch circuit electrically connected to the shift register circuit, and configured to sample the received digital signal to obtain a sampled signal based on the sampling pulse signal;

a second latch circuit electrically connected to the first latch circuit, and configured to detect a boundary value of the sampled signal in a specified grayscale range;

a level shift circuit electrically connected to the second latch circuit, and configured to modulate the sampled signal;

a digital-to-analog (DAC) circuit electrically connected to the level shift circuit, and configured to convert the modulated sampled signal into driving voltage according to a reference voltage; and an output circuit electrically connected to the DAC circuit, and configured to output the driving voltage to a data line;

wherein the second latch circuit further compares the boundary value of the sampled signal with the boundary value of a previous sampled signal and outputs a compensation control signal to the output circuit based on a comparison result; wherein if the boundary value of the sampled signal is different from the boundary value of the previous sampled signal, the compensation control signal is in an effective state; the output circuit further sets the voltage of the data line at a specified voltage in response to the compensation control signal in the effective state before outputting the driving voltage to the data line;

wherein the specified grayscale range can be adjusted according to a bit number of the digital signal.

7. The display apparatus of claim 6, wherein the second latch circuit comprises a encoding unit, a latch unit, and a comparison unit; the encoding unit receives the digital signal and a selection signal; the encoding unit sets the specified grayscale range based on the selection signal, and converts the digital signal to obtain a sampled signal; the latch unit latches a previous sampled signal corresponding to the data line, and outputs the previous sampled signal corresponding to the data line to the comparison unit, and latches the current sampled signal; the comparison unit compares the boundary value of the sampled signal and the boundary value of the previous sampled signal.

8. The display apparatus of claim 6, wherein the boundary value is a most significant bit of the sample signal.

9. The display apparatus of claim 6, wherein the specified grayscale range is from 65 grayscale to 191 grayscale.

10. The display apparatus of claim 6, wherein if the boundary value of the sampled signal is the same as the boundary value of the previous sampled signal, the compensation control signal is in an ineffective state; the output circuit outputs the driving voltage to the corresponding data line.

* * * * *